US005213311A

United States Patent [19]

Sabo

[11] Patent Number: 5,213,311

[45] Date of Patent: May 25, 1993

[54] NAIL EXTRACTOR

[76] Inventor: Ronald J. Sabo, 6041 Cascade Hill Cv., Bartlett, Tenn. 38135

[21] Appl. No.: 950,028

[22] Filed: Sep. 24, 1992

[51] Int. Cl.[5] ..... B25C 11/00

[52] U.S. Cl. ..... 254/24

[58] Field of Search ..... 29/259-263, 29/275, 254, 255; 254/18, 21, 22, 23, 24

[56] References Cited

U.S. PATENT DOCUMENTS

| | | | |
|---|---|---|---|
| 155,429 | 9/1874 | Devine . | |
| 401,113 | 4/1989 | Baumeister . | |
| 559,803 | 5/1896 | Johnson . | |
| 712,083 | 10/1902 | Morrill . | |
| 2,036,782 | 4/1936 | Ullmo | 29/263 |
| 2,735,649 | 2/1956 | Swallert . | |
| 3,824,672 | 7/1974 | Michelsen | 29/263 |
| 3,972,103 | 8/1976 | Kenyon | 29/263 |
| 3,978,576 | 9/1976 | Mustoe . | |
| 4,007,913 | 2/1977 | Aldrich | 254/18 |
| 4,059,883 | 11/1977 | Osborne | 29/263 |
| 4,076,217 | 2/1978 | Haller et al. | 254/131 |
| 4,078,766 | 3/1978 | Saurwein . | |
| 4,694,569 | 9/1987 | Colvell et al. | 29/260 |

*Primary Examiner*—Robert C. Watson

*Attorney, Agent, or Firm*—Walker, McKenzie & Walker

[57] ABSTRACT

A device for extracting nails or the like from a workpiece. The extractor includes a body member having a first end and a second end; a plurality of leg members, each of the leg members having a first end and a second end, the first end of each of the leg members being attached to the second end of the body member; and a collar slidably positioned over at least a portion of the leg members for causing the second ends of the leg members to be urged inwardly. The extractor is preferably machined or otherwise constructed out of metal.

3 Claims, 2 Drawing Sheets

NAIL EXTRACTOR

BACKGROUND OF THE INVENTION

1. Field of the Invention

The present invention relates, in general, to means for removing nails, pins, spikes and the like from wood and the like.

2. Description of the Related Art

Various means and methods have been developed over the years for use in extracting or removing nails, pins, spikes and the like from wood and the like. Perhaps, the most common nail extraction tools are the typical claw hammer and the typical crowbar. These tools require the user to force the distal end of the claw hammer or crowbar under the head of the nail, and then to use the claw hammer or crowbar as a lever to urge the head of the nail upward. The problems associated with removing a nail or the like that has been completely driven into a workpiece or the like so that the head of the nail is flush or even slightly below the outer surface of the workpiece are well known and include sever damage to the surface of the workpiece, injury to the worker attempting to use a claw hammer or crowbar to remove such nails, etc. Typically, a claw hammer, crowbar or pry bar is used to first pry the workpiece from its attached structure in hopes of exposing the head of the nail. However, this often results in breaking the lumber or underlying structure. Present devices and methods used to remove nails holding plywood or sheeting to existing structure usually results in broken plywood or sheeting.

A preliminary patentability search was conducted in class 254, subclasses 18, 20 and 21.

Devine, U.S. Pat. No. 155,429, issued Sep. 29, 1874, discloses a spike extractor for removing spikes from wood. The spike extractor includes a frame, a screw mounted for vertical movement in the frame, a grapple for being attached to the lower end of the screw and having a pair of jaws for being driven into the wood around the upper end of the spike, and a becket or ring for compressing the jaws against the spike so that rotation of the screw will cause the grapple to move and cause the spike to be extracted from the wood.

Baumeister, U.S. Pat. No. 401,113, issued Apr. 9, 1889, discloses a nail extractor for withdrawing nails from wood. The nail extractor includes a shell, a sliding carrier mounted within the shell, jaws within the carrier projecting below the carrier and having inwardly-turned edges at their extremities to undercut the head of a nail, a spring for urging the jaws downward, another spring for opening the jaws when raised, and cam means for turning the carrier and jaws backward to cut away the wood from under the head of the nail and for raising them straight outward to withdraw the nail from the wood.

Johnson, U.S. Pat. No. 559,803, issued May 12, 1896, discloses a horseshoe-calk extractor including a tubular body, a branched standard received in one end of the body, a pair of semicylindrical clamping-jaws coupled to one end of the standard, and a cam-crank arm combination coupled to the other end of the standard for drawing the standard and the clamping jaws into the body.

Morrill, U.S. Pat. No. 712,083, issued Oct. 28, 1902, discloses a spike extractor including an upright frame, a lifting block mounted for vertical movement within the frame, a lever cam pivotally attached to the frame for engaging the lifting block through antifriction rollers, and a pair of gripping jaws coupled to the lifting block through a rod whereby movement of the lever cam will cause vertical movement of the lifting block and, thereby, the gripping jaws.

Swallert, U.S. Pat. No. 2,735,649, issued Feb. 21, 1956, discloses a pneumatic spike extractor including a pneumatic piston having a piston rod, two jaws pivotably mounted on the outer end of the rod, a double-armed lever pivotably mounted on the piston rod for locking the jaws in an opened position when the piston rod is retracted and in a gripping position when the piston rod is protruded.

Mustoe, Jr., U.S. Pat. No. 3,978,576, issued Sep. 7, 1976, discloses a nail extractor including a cylinder, a piston reciprocable in the cylinder under the influence of fluid pressure, a pair of gripping jaws located externally of the cylinder, at least one of which is movable between nail gripping and non-gripping positions as a result of mechanical interactions between the piston and the movable jaw upon displacement of the piston towards and away from the jaws under the action of fluid pressure.

Saurwein, U.S. Pat. No. 4,078,766, issued Mar. 14, 1978, discloses a fluid actuated nail extractor including a pair of jaws pivotally mounted on a reciprocable rod. An impact piston impacting a second rod coupled to the jaws closes the jaws about a nail embedded in a workpiece when the extractor is positioned adjacent the nail. A second piston actuates the reciprocable rod to extract the nail from the workpiece. Pressurized fluid, controlled by a plurality of poppet valves, drives the pistons through a predetermined sequence of operations.

Nothing in the prior art discloses or suggests the present invention. More specifically, nothing in the prior art discloses or suggests a nail extractor including a body member having a first end and a second end; at least three leg members, each of the leg members having a first end and a second end, the first end of each of the leg members being attached to the second end of the body member; and collar means slidably positioned over at least a portion of the leg members for causing the second ends of the leg members to be urged inwardly.

SUMMARY OF THE INVENTION

The present invention is directed toward providing an improved device for extracting nails and the like from workpieces and the like. The concept of the present invention is to provide an extraction device that is capable of removing 16d to 8d (16 penny to 8 penny) nails that have been driven into wood workpieces or the like completely, with the nail heads flush with the surface of the wood.

The device of the present invention includes, in general, a body member having a first end and a second end; at least three leg members, each of the leg members having a first end and a second end, the first end of each of the leg members being attached to the second end of the body member; and collar means slidably positioned over at least a portion of the leg members for causing the second ends of the leg members to be urged inwardly.

One object of the present invention is to provide a device that will considerably reduce the time and effort required to remove nails from workpieces and the like.

Another object of the present invention is to provide such a device that will reduce or eliminate damage to lumber and the like when nails are removed therefrom, to thereby conserve materials.

DESCRIPTION OF THE PREFERRED EMBODIMENT

Figure 1:
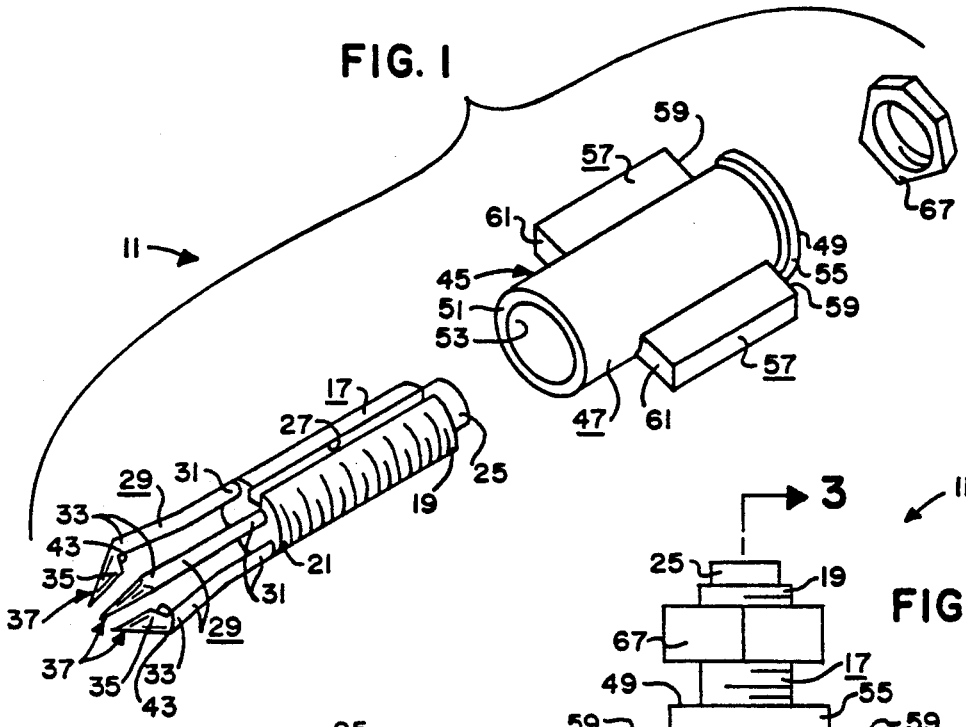
FIG. 1 is an exploded perspective view of the nail extractor of the present invention.
Figure 2:
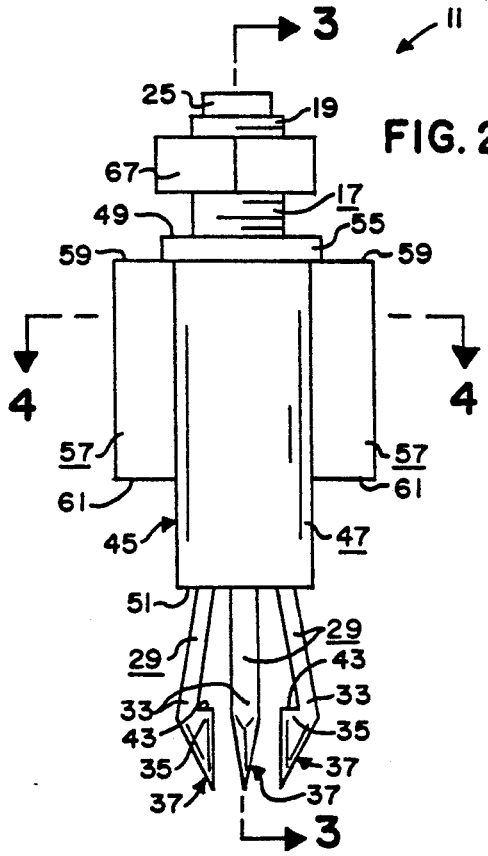
FIG. 2 is a front elevational view thereof

The preferred embodiment of the device or extractor of the present invention is shown in FIGS. 1-15 of the drawings, and identified by the numeral 11. The extractor 11 is designed for extracting a nail 13 or the like from a workpiece 15 such as a piece or wood, lumber, or the like. The nail 13 includes a normally upper end typically having an enlarged head 16.

The extractor 11 includes a body member 17 having a first end 19 and a second end 21. The body member 17 preferably consists of an elongated hardened tool steel cylinder having external threads extending between the first and second ends 19, 21 thereof. A boss or head 25 may be provided on the first end 19 of the body member 17 or the first end 19 may be otherwise designed so as to take repeated hammer blows without peening over the edges or otherwise damaging the external threads A keyway 27 may extend between the first and second ends 19, 21 of the body member 17.

The extractor 11 includes at least three and preferably four leg members 29. Each leg member 29 has a first end 31 and a second end 33. The first end 31 of each leg member 29 is attached to the second end 21 of the body member 17. For example, four equally spaced holes may be drilled into the second end 21 of the body member 17 and the first end 31 of a leg member 29 may be inserted into each hole and welded or otherwise fixedly attached to the body member 17. The leg members 29 are preferably machined or otherwise formed from high carbon spring steel. The leg members 29 preferably diverge slightly outwardly from the longitudinal axis of the body member 17 toward the second ends 33 thereof as clearly shown in FIG. 3. More specifically, the leg members 29 are preferably normally springably urged to a fully opened position with the second ends 21 thereof apart from one another a maximum distance, depending on the design and size thereof, etc., and can be manually urged to a fully closed position with the second ends 21 thereof substantially adjacent one another for reasons which will hereinafter become apparent.

The extractor 11 preferably includes a barb member 35 attached to the second end 33 of each leg member 29. The barb members 35 are preferably fashioned from Tungsten Carbide alloy and bonded to the second ends 33 of the leg members 29. The shape of each barb member 35 and the adjacent portion of the second end 33 of each leg member 29 (hereinafter referred to as the tip 37 of each leg member 29) is important to the operation of the extractor 11 and the ease of penetration of the tips 37 into the workpiece 15. Thus, outer edge 39 of the tip 37 of each leg member 29 is preferably sharpened (see, in general, FIG. 7) and slanted downwardly and inwardly (see, in general, FIGS. 2 and 3). The sharpness of the outer edge 39 of each tip 37 allows the tips 37 to penetrate the workpiece 15 with a minimum of force while the downwardly and inwardly slope of the outer edges 39 keeps the tips 37 against or adjacent the upper end (e.g., the head 16) of the nail 13 and penetrating the workpiece 15 at substantially a 90 degree angle to the surface thereof. The inner edge 41 of the tip 37 of each leg member 29 (i.e., the edge facing the nail 13) is also preferably sharpened (see, in general, FIGS. 6 and 7) and positioned substantially parallel to the longitudinal axis of the body member 17 (see, in general, FIGS. 2 and 3). The sharpness of the inner edge 41 of each tip 37 also allows the tips 37 to penetrate the workpiece 15 with a minimum of force and reduces the force required to converge the tips 37 to or toward the shaft of the nail 13. Each barb member 35 preferably forms a shelf 43 or the like adjacent the proximal end of the inner edge 41 for extending below and engaging the head 16 of the nail 13 in a manner that will hereinafter become apparent.

The extractor 11 includes collar means 45 slidably positioned over at least a portion of the leg members 29 for causing the second ends 33 of the leg members 29 to be urged inwardly. The collar means 45 preferably includes a tubular body 47 having a first end 49, a second end 51 and a central aperture 53 extending between the first and second ends 49, 51. The collar means 45 may include an outwardly extending lip 55 at the first end 49 of the tubular body 47. The diameter of the central aperture 53 is slightly larger than the diameter of the body member 17 so that the collar means 45 will freely slide back and forth over the body member 17 However, the second end 51 of the tubular body 47 will engage the diverging leg members 29 at a point between the first and second ends 31, 33 of the leg members 29 (see, in general, FIG. 3). Accordingly, continued movement of the collar means 45 toward the second ends 33 of the leg members 29 will cause the second ends 33 of the leg members 29 and the barb members 35 to be forced inwardly toward the longitudinal axis of the body member 17, etc., as will now be apparent to those skilled in the art, for reasons which will hereinafter become apparent.

The collar means 45 preferably includes a pair of arm members or wings 57. The arm members 57 preferably extend outwardly from opposite sides of the tubular body 47 as clearly shown in FIG. 4. Each arm member 57 has a first end 59 and a second end 61.

The collar means 45 may be machined or otherwise constructed from metal or the like in any manner now apparent to those skilled in the art. Thus, the tubular body 47 and arm members 57 may be machined or cast as an integral, one-piece unit. On the other hand, the tubular body 47 and arm members 57 may be machined or otherwise formed as separate components and welded or otherwise fixedly joined to one another.

Figure 3:
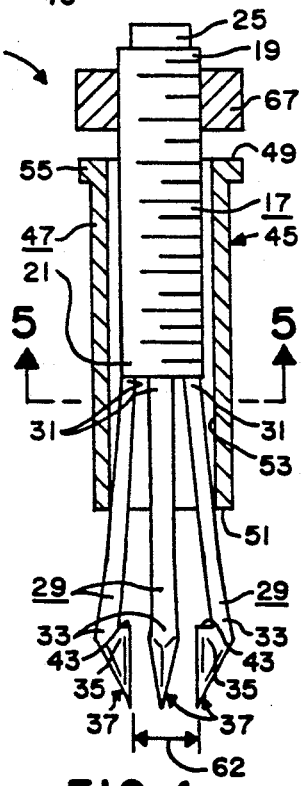
FIG. 3 is a sectional view thereof substantially as taken on line 3—3 of FIG. 2.
Figure 4:
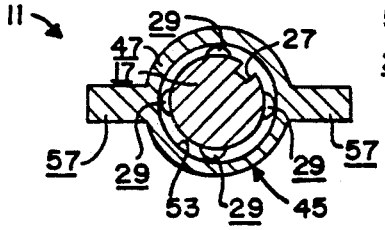
FIG. 4 is a sectional view thereof substantially as taken on line 4—4 of FIG. 2 with portions thereof omitted for clarity.
Figure 5:
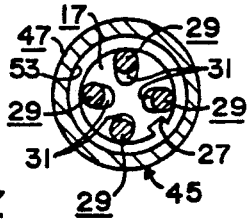
FIG. 5 is a sectional view thereof substantially as taken on line 5—5 of FIG. 3 with portions thereof omitted for clarity.
Figure 6:
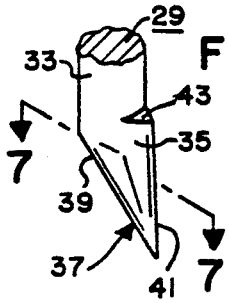
FIG. 6 is an enlarged perspective view of a portion of one leg member and one barb member of the nail extractor of FIG. 1.
Figure 7:
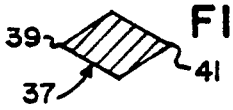
FIG. 7 is a sectional view substantially as taken on line 7—7 of FIG. 6.
Figure 8:
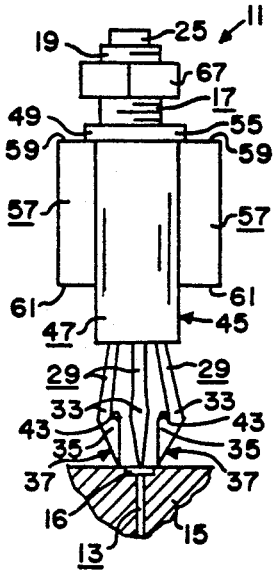
FIGS. 8-10 are somewhat diagrammatic front elevational views thereof showing the nail extractor of the present invention in combination with a nail and a workpiece.
Figure 9:
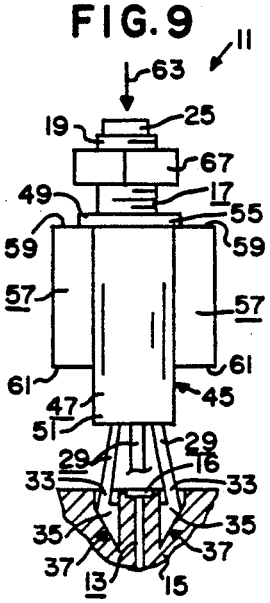
Figure 10:
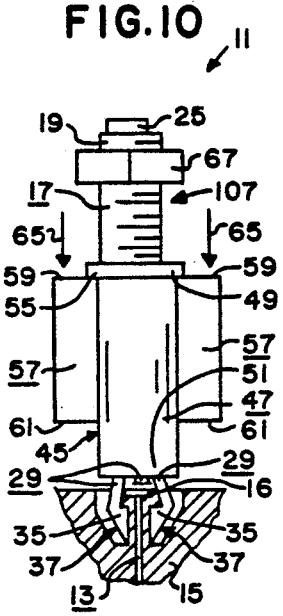
Figure 11:
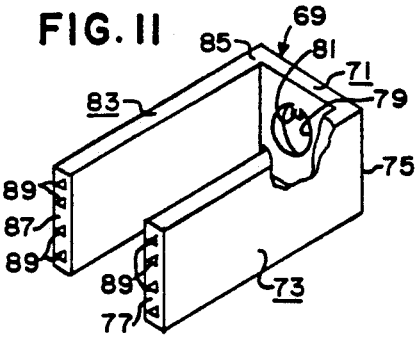
FIG. 11 is a perspective view of a first embodiment of an extractor support for use with the nail extractor of FIG. 1.

To properly position the extractor 11 relative to a nail 13 to be removed, the body member 17 is centered over the head 16 of the nail 13 with the distal ends of the tips 37 located substantially at the edge or periphery of the head 16 substantially as shown in FIG. 8. The extractor Il may be adjusted so that the distance between the distal ends of the tips 37 as indicated by the arrow 62 in FIG. 3 is just slightly larger than the diameter of the head 16 of the nail 13. This adjustment can be made by merely moving the tubular body 47 back and forth along the leg members 29 until the desired distance between the distal ends of the tips 37 is achieved. The extractor 11 may include means for helping make such adjustments. Thus, spaced detent means or the like (not shown) may be provided between the body member and the tubular body 45 with each detent position corresponding to a different standard nail head size, etc., so that movement of the tubular body 47 between the different detent means will cause the tips 37 to move toward and away from one another between the different standard dimensions as will now be apparent to those skilled in the art. Next, force is applied to the body member 17 to drive the tips 37 into the workpiece 15, normally until the shelf 43 is below the head 16 of the nail 13 substantially as shown in FIG. 9. Force may be applied to the body member 17 by striking the head 25 thereof with a hammer or the like as indicated by the arrow 63 in FIG. 9. Next, force is applied to the collar means 45 to drive the tubular body 47 toward the second ends 33 of the leg members 29 to thereby force the barb members 35 inwardly toward the longitudinal axis of the nail 13 and cause the shelves 43 to be positioned under the head 16 of the nail 13 substantially as shown in FIG. 10, and/or cause the inner edge 41 of each tip 37 to grip the outer wall of the body of the nail 13. Force may be applied to the collar means 45 by striking the first ends 59 of the arm members 57 with a hammer or the like as indicated by the arrows 65 in FIG. 10. The nail 13 will then be substantially secured to the extractor 11 so that movement of the extractor 11 away from the workpiece 15 will cause the nail 13 to be extracted from the workpiece 15 as will now be apparent to those skilled in the art.

The extractor 11 preferably includes a nut member 67 for being screwably coupled to the external threads of the body member 17. The nut member 67 preferably consists of a typical, off-the-shelf nut of the appropriate size for properly mating with the external threads of the body member 17.

The extractor 11 may include a bridge means 69 for providing support for the body member 17 as the nail 13 is extracted from the workpiece 15. The bridge means 69 preferably includes a flange 71 and at least a first leg member 73 for supporting the flange 71 above the workpiece 15. The first leg member 73 preferably has a first end 75 attached to the flange 71 and a second end 77 for engaging the workpiece 16 (see, in general, FIGS. 12 and 13). The flange 71 preferably has an aperture 79 therethrough for allowing the body member 17 to extend therethrough. The aperture 79 is preferably sized so as to allow the body member 17 to freely slide back and forth therein. A key 81 is preferably formed in the aperture 79 for mating with the keyway 27 in the body member 17 to prevent the body member 17 from rotating relative to the flange 71 for reasons which will hereinafter become apparent The bridge means 69 preferably includes a second leg member 83 for coacting with the first leg member 73 to stably support the flange 71 above the workpiece 15. Thus, the second leg member 83 preferably has a first end 85 attached to the flange 71 and a second end 87 for engaging the workpiece 15 The leg members 73, 83 are preferably attached to opposite ends of the flange 71 whereby the bridge means 69 is substantially U-shaped in side elevation as clearly shown in FIGS. 12 and 13. Teeth 89 are preferably provided on the second ends 77, 87 of the leg members 73, 83 for securely gripping the workpiece 15 and to prevent or hinder the bridge means 69 from rotating o the workpiece 15.

Figure 12:
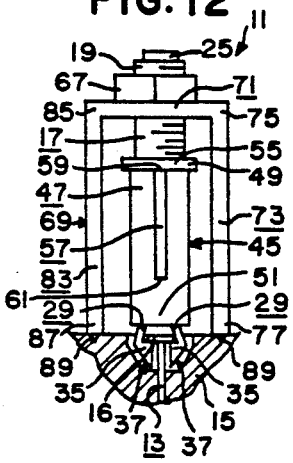
FIGS. 12 and 13 are somewhat diagrammatic side elevational views of the nail extractor of FIG. 1, shown in combination with a nail, a workpiece, and the extractor support of FIG. 11.
Figure 13:
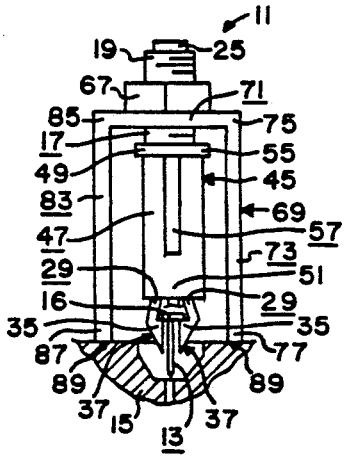
Figure 14:
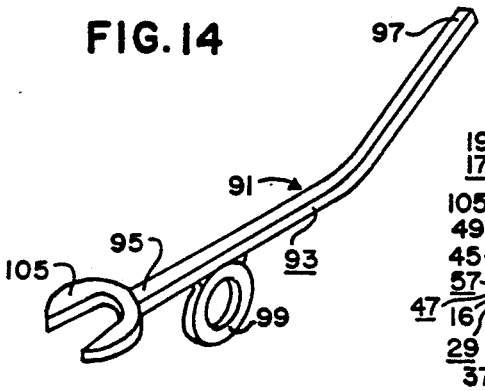
FIG. 14 is a perspective view of a second embodiment of an extractor support for use with the nail extractor of FIG. 1.
Figure 15:
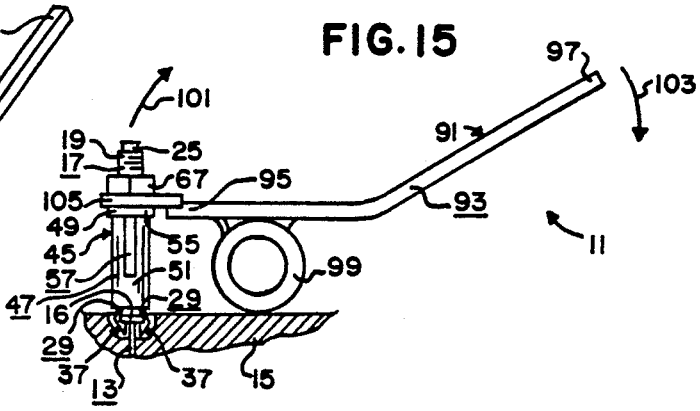
FIG. 15 is a somewhat diagrammatic side elevational view of the nail extractor of FIG. 1, shown in combination with a nail, a workpiece, and the extractor support of FIG. 14.

To use the bridge means 69 to extract the nail 13 from the workpiece 15, after the nail 13 has been substantially secured to the extractor 11 as described hereinabove relative to FIGS. 8, 9 and 10 and with the nut member 67 removed from the body member 17, the bridge means 69 is merely placed over the body member 17 with the first end 19 of the body member 17 extending through the aperture 79 in the flange 71 and with the key 81 mating with the keyway 27. Next, the nut member 67 is screwed onto the external threads of the body member 17 until the teeth 89 on the second ends 77, 87 of the first and second leg members 73, 83 are forced into the workpiece 15 substantially as shown in FIG. 12. The combination of the teeth 89 and the key 81, keyway 27 assembly will prevent the body member 17, leg members 29, and tips 37, etc., from rotating as the nut member 67 is rotated on the body member 17. As the nut member 67 is further screwed onto the body member 17, the body member 17, leg members 29, tips 37 and nail 13 will be extracted from the workpiece 15 as indicated in FIG. 13 and as will now be apparent to those skilled in the art.

The extractor 11 may include extractor bar means 91 for pulling the body member 17 and the nail 13, etc., away from the workpiece 15. The extractor bar means 91 preferably includes an elongated handle 93 having a first end 95 adapted for being attached to the first end 19 of the body member 17 and having a second end 97. The extractor bar means 91 also preferably includes pivot means 99 for engaging the workpiece 15 or an adjacent stable surface, and for allowing the first end 95 of the elongated handle 93 to pivot away from the face of the workpiece 15 in the direction indicated by the arrow 101 in FIG. 15 when the second end 97 of the elongated handle 93 is forced toward the face of the workpiece 15 in the direction indicated by the arrow 103 in FIG. 15. The pivot means 99 may be defined merely by a curved bend in the elongated handle 93 between the first and second ends 95, 97 thereof. However, the pivot means 99 preferably consists of a rigid, washer or tube-like member for being welded or otherwise attached to the elongated handle 93 between the first and second ends 95, 97 thereof as clearly shown in FIGS. 14 and 15. The first end 95 of the elongated handle 93 preferably includes a U-shaped member 105 for extending around the body member 17 directly below the nut member 67. The U-shaped member 105 may be machined or otherwise formed from metal and welded or otherwise securely attached to the first end 95 of the elongated handle 93.

To use the extractor bar means 91 to extract the nail 13 from the workpiece 15, after the nail 13 has been substantially secured to the extractor 11 as described hereinabove relative to FIGS. 8, 9 and 10 and with the nut member 67 secured to the body member 17 with a gap 107 between the nut member 67 and the collar means 45 as shown in FIG. 10, the extractor bar means 91 is merely positioned with the U-shaped member 105 extending around the body member 17 in the gap 107 and with the pivot means 99 engaging the surface of the workpiece 15 or some other stable surface. The second end 97 of the elongated handle 93 is then merely forced toward the face of the workpiece 15 in the direction indicated by the arrow 103 in FIG. 15, causing the body member 17, leg members 29, tips 37 and nail 13 to be pulled away from the workpiece 15 in the direction indicated by the arrow 101 in FIG. 15 as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A device for extracting a nail from a workpiece, said device comprising:

a) a body member having a first end and a second end;

b) at least three leg members, each of said leg members having a first end and a second end, said first end of each of said leg members being attached to said second end of said body member; and c) collar means slidably positioned over at least a portion of said leg members for causing said second ends of said leg members to be urged inwardly; said collar means including a pair of arm members.

2. A device for extracting a nail from a workpiece, said device comprising:

a) a body member having a first end and a second end;

b) at least three leg members, each of said leg members having a first end and a second end, said first end of each of said leg members being attached to said second end of said body member; and c) collar means slidably positioned over at least a portion of said leg members for causing said second ends of said leg members to be urged inwardly; said collar means including at least one arm member.

3. A device for extracting a nail from a workpiece, said device comprising:

a) a body member having a first end and a second end;

b) a plurality of leg members, each of said leg members having a first end and a second end, said first end of each of said leg members being attached to said second end of said body member; and c) collar means slidably positioned over at least a portion of said leg members for causing said second ends of said leg members to be urged inwardly; said collar means including means for allowing striking force to be applied to said collar means to cause said collar means to slide over at least a portion of said leg members.

* * * * *